US005251608A

United States Patent [19]

Cote

[11] Patent Number: 5,251,608

[45] Date of Patent: Oct. 12, 1993

[54] AIR CANOPY VENTILATION SYSTEM

[76] Inventor: Cameron Cote, 1047 MacKid Road, NE, Calgary, Alberta T2E 6A8, Canada

[21] Appl. No.: 734,179

[22] Filed: Jul. 22, 1991

Related U.S. Application Data

[63] Continuation-in-part of Ser. No. 530,746, Apr. 30, 1990, Pat. No. 5,042,456.

[51] Int. Cl.[5] ..... B08B 15/02

[52] U.S. Cl. ..... 126/299 D; 454/56

[58] Field of Search ..... 126/299 A, 299 D; 454/49, 56, 57, 66, 67, 193; 55/337, DIG. 36

[56] References Cited

U.S. PATENT DOCUMENTS

| | | | |
|---|---|---|---|
| 2,544,769 | 3/1951 | Sperry et al. | 454/66 |
| 2,649,727 | 8/1953 | Snow et al. | 454/57 |
| 2,794,514 | 6/1957 | Risley | 454/67 X |
| 2,889,007 | 6/1959 | Lunde | 454/67 X |
| 3,021,776 | 2/1962 | Kennedy | 454/57 |
| 3,131,687 | 5/1964 | Kalla . | |
| 3,260,189 | 7/1966 | Jensen . | |
| 3,292,525 | 12/1966 | Jensen . | |
| 3,303,839 | 2/1967 | Tavan . | |
| 3,358,579 | 12/1967 | Hauville . | |
| 3,386,365 | 6/1968 | Jensen . | |
| 3,387,551 | 6/1968 | Hughes . | |
| 3,425,335 | 2/1969 | Black | 454/57 |
| 3,585,919 | 6/1971 | Culpepper, Jr. . | |
| 3,785,124 | 1/1974 | Gaylord | 55/118 |
| 4,050,368 | 9/1977 | Eakes . | |
| 4,467,782 | 8/1984 | Russell . | |

FOREIGN PATENT DOCUMENTS

| | | | |
|---|---|---|---|
| 254816 | 9/1963 | Australia | 55/337 |
| 833886 | 2/1970 | Canada . | |
| 1045885 | 1/1979 | Canada . | |
| 734253 | 3/1943 | Fed. Rep. of Germany | 55/337 |
| 2737386 | 3/1978 | Fed. Rep. of Germany . | |
| 2308872 | 12/1976 | France . | |
| 1012955 | 4/1983 | U.S.S.R. | 55/337 |
| 540982 | 11/1941 | United Kingdom | 55/337 |

*Primary Examiner*—Harold Joyce

*Attorney, Agent, or Firm*—Bean, Kauffman & Spencer

[57] ABSTRACT

An air canopy system for use with equipment producing fumes whose escape into the environment adjacent the equipment is not desired. The system comprises rear and side walls adapted to upstand from adjacent rear and sides of the equipment; an upper canopy surmounting the rear and side walls and cooperating therewith to define a volume for receiving fumes produced by the equipment; an arranged to extend substantially between the side walls in a forwardly spaced relationship from the front of the equipment for cooperation therewith to bound a makeup air receiving inlet for permitting passage of air from the environment into the volume and for cooperation with the side walls and the upper canopy to bound an access opening for the volume, wherein the air curtain is directed towards the upper canopy for preventing escape of fumes from the volume through the access opening; and an exhaust inlet extending along an upper extent of the rear wall for withdrawing fumes and air from the volume.

29 Claims, 4 Drawing Sheets

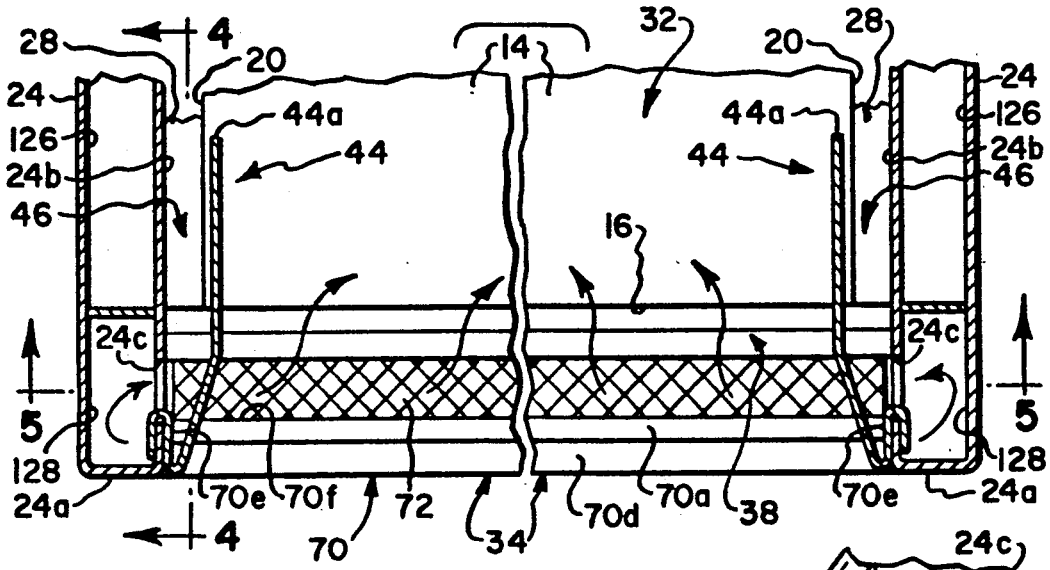
Fig. 3.
Fig.4.
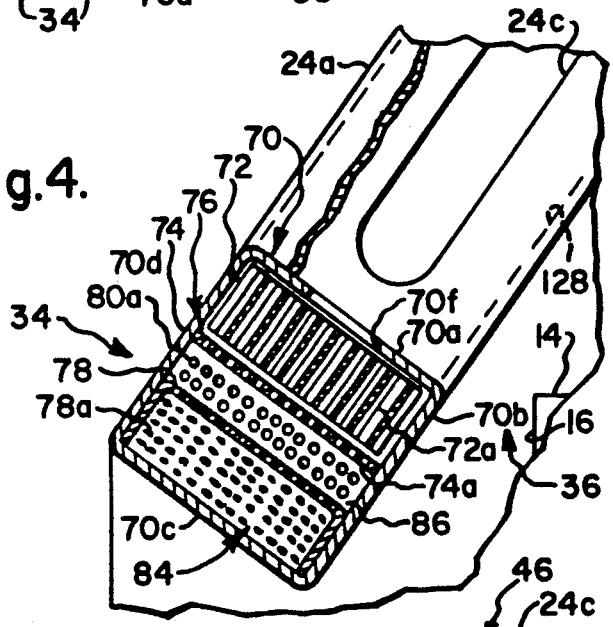
Fig. 5.
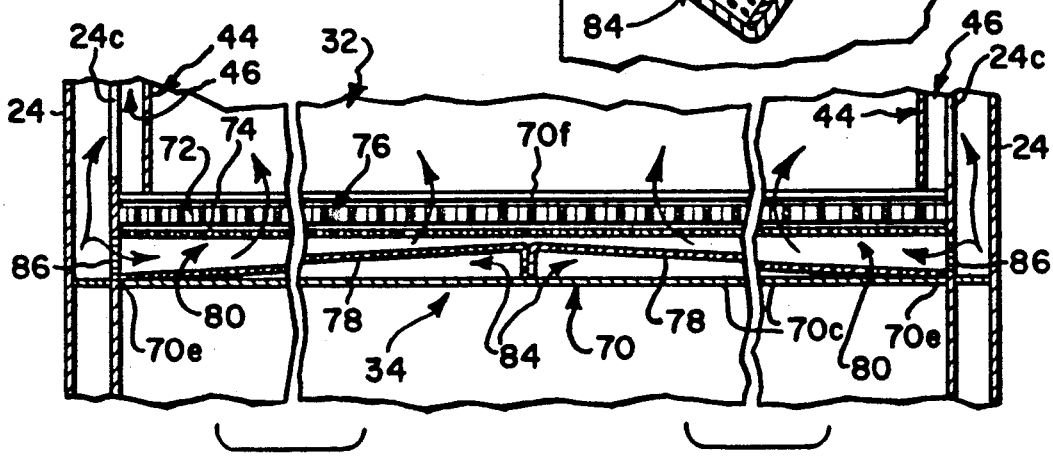

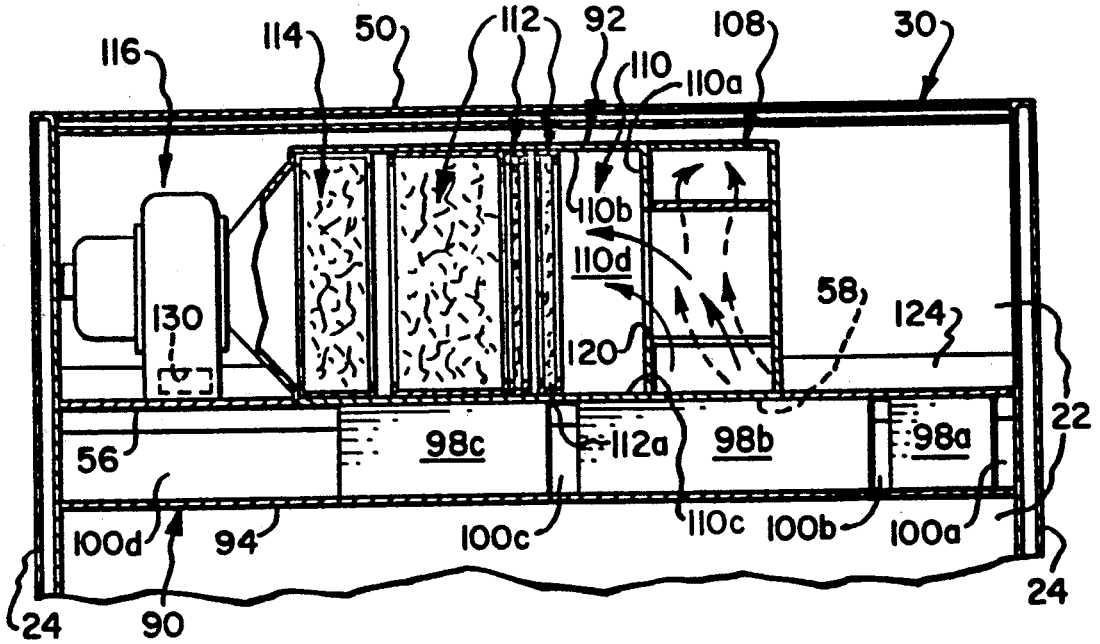
Fig. 6.
Fig. 7.
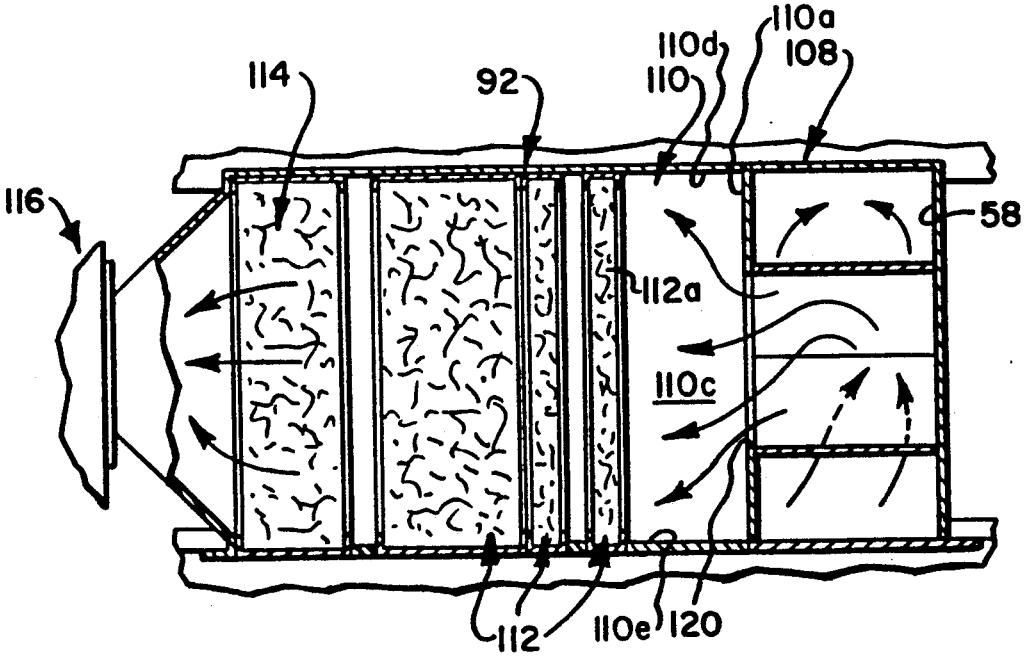

AIR CANOPY VENTILATION SYSTEM

RELATED APPLICATION

This application is a continuation-in-part of U.S. patent application Ser. No. 07/530,746, filed Apr. 30, 1990, U.S. Pat. No. 5,042,456.

FIELD OF THE INVENTION

This invention relates to canopy venting systems, and more particularly to canopy venting systems suitable for use in controlling and containing noxious and undesirable fumes produced by equipment, such as cooking surfaces and laboratory equipment of diverse types.

DESCRIPTION OF THE RELATED ART

Systems for collecting fumes generated in laboratory and cooking equipment are known in which an exhaust vent is powered by a suction fan and located in a canopy above the equipment and fumes are drawn upwardly by the exhaust vent for discharge to the exterior of a building or after filtering are returned to the immediate environment of the equipment. Such systems may be combined with a venting means intended to provide for a curtain of downflowing air from the front of the canopy to decrease the air and fume flow into the room. In application to cooking systems, such systems are designed to be mounted on a wall above the stove cooking surface, with considerable clearance therefrom, or to be integrally constructed with the stove, but nevertheless with the same clearance.

For example, Canadian Patent No. 833,886 discloses a ventilating hood structure for removing fumes from a source located near the hood, including creating a low pressure zone near the source of fumes and partially surrounding it with a supply of air under pressure, so as to entrain the fumes which are thereafter removed from the zone by an exhaust fan which creates the low pressure zone.

Canadian Patent No. 1,045,885 describes a kitchen ventilator including a housing to be mounted above a kitchen stove, and including means for producing a downwardly flowing air curtain to restrain odors and fumes produced by cooking on the stove.

U.S. Pat. No. 4,050,368 (Eakes) discloses an industrial style exhaust system which uses an air curtain to trap contaminated air and remove it. U.S. Pat. No. 3,021,776 (Kennedy) discloses a laboratory fume hood using different velocities of side moving air to trap fumes and remove them. The use of this type of system has been banned in some areas. U.S. Pat. No. 3,131,687 (Kalla) describes an air curtain type of ventilating system that uses directed air to move contaminated air and is directed towards home stove units. U.S. Pat. Nos. 3,425,335 (Black) and 3,358,579 (Hauville) disclose laboratory fume hoods that exhaust contaminated air to the outside. U.S. Pat. No. 3,303,839 (Tavan) describes a portable vertical air curtain device that exhausts the contaminated air along with large volumes of room air.

In my co-pending U.S. patent application Ser. No. 07/530,746, an improved canopy venting system is disclosed as comprising parallel side walls and a rear wall arranged to extend upwardly from each side and the rear of a cooking surface; an upper canopy surmounting the side and rear walls, vent means adjacent to and extending substantially the whole length of a front edge of the cooking surface; means connected to and adapted for driving a flow of air through the vent means upwardly towards the upper canopy so as to form in use an upwardly directed air curtain; exhaust means disposed laterally inwardly from the plane of the air curtain for continuously exhausting the upper portion of said air curtain together with cooking fumes generated during operation of the cooking surface upwardly through the upper canopy; and means for creating a supplementary air flow inwardly of the side walls to improve the integrity of the vertical edges of the air curtain. In one form of the system, the front of the upper canopy is disposed rearwardly of the vent means and the vent means arranged to direct the air curtain upwardly and rearwardly of the front of the upper canopy.

SUMMARY OF THE INVENTION

An object of the present invention is to provide an air canopy system, which possesses certain advantages and improvements over that described in my co-pending U.S. patent application Ser. No. 07/530,746 particularly as regards the uniformity and integrity of the air curtain and the elimination of escape of fumes under even the most adverse conditions, such as momentarily occurs when a cooking surface is quickly covered with excessive fume generating products, such as hamburgers.

The present invention additionally includes improved exhaust means which provides for essentially uniform fume removal lengthwise of the cooking surface and an improved exhaust fume flow control arrangement, which maximizes the effectiveness of otherwise conventional filter elements previously employed in the system.

BRIEF DESCRIPTION OF THE DRAWINGS

The nature and mode of operation of the present invention will now be more fully described in the following detailed description taken with the accompanying drawings wherein:

FIG. 3 is an enlarged sectional view taken generally along the line 3—3 in FIG. 2;

FIG. 4 is an enlarged sectional view taken generally along the line 4—4 in FIG. 3;

FIG. 5 is a sectional view taken generally along the line 5—5 in FIG. 3;

FIG. 6 is a sectional view taken generally along the line 6—6 in FIG. 2;

FIG. 7 is a sectional view taken generally along the line 7—7 in FIG. 1.

DETAILED DESCRIPTION

Figure 1:
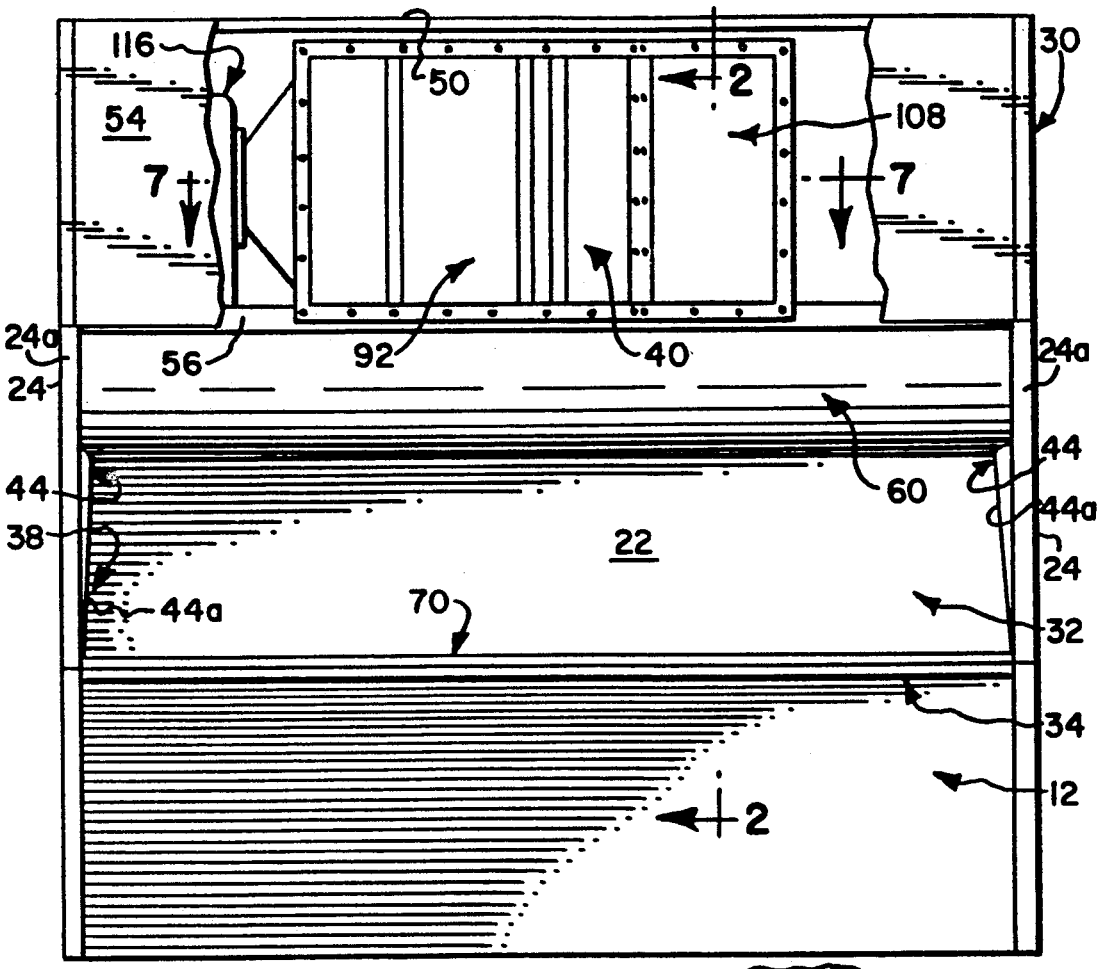
FIG. 1 is a front elevational view of an air canopy system formed in accordance with the present invention with portions broken away to show its air filtering system.
Figure 2:
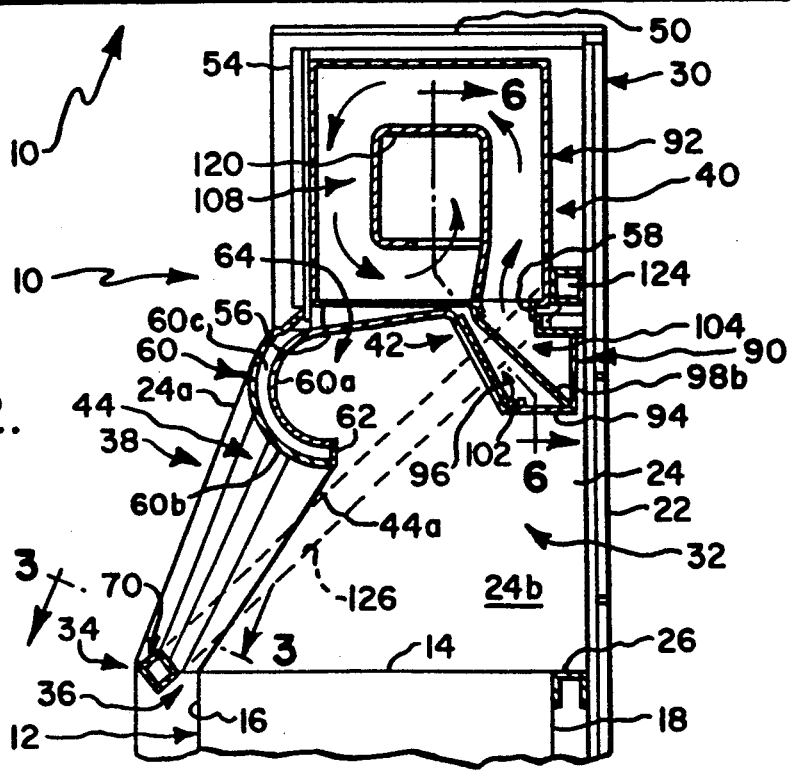
FIG. 2 is a sectional view taken generally along the line 2—2 in FIG. 1.

An air canopy system formed in accordance with the present invention is generally designated as 10 and shown in FIGS. 1-3 as being arranged in association with fume producing equipment 12, such as for instance a conventional cooking equipment having an upwardly facing cooking surface 14 and front, rear and opposite sides 16, 18 and 20, respectively. Surface 14 may, for example, be in the form of a stationary and movable grill or a griddle to which food is directly applied for cooking purposes, a heating element on which containers, such as frying pans, are intended to be placed, or deep fryers.

System 10 generally includes rear and opposite side walls 22 and 24 arranged to upstand from adjacent rear and opposite sides 18 and 20 with any spaces present therebetween being essentially filled by suitable filler plates 26 and 28 preferably arranged generally coplanar with cooking surface 14; an upper canopy or housing 30 surmounting rear wall 22 and side walls 24 and cooperating therewith to define a volume 32 for receiving fumes produced by equipment 12; air curtain producing vent means 34 arranged to extend substantially between side walls 24 in a forwardly spaced relationship to front 16 for cooperation therewith to define a makeup air receiving inlet or slot opening 36 for permitting passage of air from the environment surrounding the system into volume 32 and for cooperation with side walls 24 and upper canopy 36 to bound an access opening 38, which affords user access to volume 32 and cooking surface 14; and exhaust means 40 having a filter inlet 42 for withdrawing fumes and air from volume 32. Makeup air may be suitably supplied to inlet 36, such as by leaving the front of equipment 12 exposed to the environment, as shown in FIGS. 1 and 2.

In FIG. 2, side walls 24 are shown as having front edges **24*a*, which incline upwardly and rearwardly towards upper canopy 30. In a preferred form of the invention, side walls 24 serve to mount opposite front wall portions 44, which are arranged to extend from adjacent front edges 24*a* in an inwardly spaced relationship to the side walls and terminate in rear edges 44*a*, which converge upwardly towards upper canopy 30, as viewed in FIG. 1, and are upwardly and rearwardly inclined, as viewed in FIG. 2. Front wall portions 44 cooperate with the inwardly facing surfaces 24*b* of side walls 24 to define air flow passageways 46 whose front ends are disposed in flow communication with vent slots 24*c* opening through facing surfaces 24*b* essentially parallel to front edges 24*a* and whose rear ends open downwardly and rearwardly in flow communication with volume 32. Flow of air into volume through passageways 46 serves to stabilize the vertically extending ends of the air curtain generated by vent means 34. If desired, each of vent slots 24*c*** may be replaced by a line of spaced apart vent slots or holes, not shown, of desired configuration.

Upper canopy 30 is best shown in FIGS. 1, 2 and 6 as being defined by upper ends or extensions of rear wall 22 and side walls 24; a top wall 50; a front wall 54; a bottom wall 56, which is formed with an opening 58 communicating with inlet 42; and channel portion 60, which depends from adjacent the juncture of front wall 54 and bottom wall 56 and terminates in a rearwardly facing free edge 62 disposed horizontally intermediate vent means 34 and rear wall 22. Preferably, the inner surface **60*a* of channel portion 60 is preferably a smoothly curved generally cylindrical surface arranged to define a vortex chamber 64 opening rearwardly towards inlet 42. In the preferred form of the invention, channel free edge 62, front wall portion rear edges 44*a* and vent means 34 define the boundaries of access opening 38. Further, the inner surface 60*a* and outer surface 60*b* of channel portion 60 are preferably defined by separate panels arranged in a spaced relationship to provide an air space or insulation receiving void 60*c*** for purposes of reducing transfer of heat from the inner surface to the outer surface.

Vent means 34 is best shown in FIGS. 3–5 as including an elongated, generally square cross-sectional channel 70, which is arranged to extend between side walls 24 and has side walls **70*a*–70*d*, opposite open ends 70*e* and a lengthwise extending air curtain discharge slot 70*f* opening through side wall 70*a*, which is in turn arranged in facing generally parallel relationship to channel portion 60. Preferably, channel 70, as viewed in section in FIG. 2, is tilted such that a plane extending lengthwise of slot 70*f* and normal to side wall 70*a* extends essentially parallel to and slightly rearwardly of free edge 62 of channel portion 60. Arranged within channel 70 is a first plate means in the form of a honeycomb element 72 which defines uniformly arranged and closely spaced parallel flow paths 72*a* arranged normal to side wall 70*a* for supplying air uniformly to slot 70*f*; a second plate means in the form of a relatively thin plate 74, which is formed with flow openings 74*a* and disposed generally parallel and in spaced relation to honeycomb element 72 to form an air distributing space 76; and a pair of third plate means 78 in the form of relatively thin plates, which cooperate with plate 74 to define a pair of flow passages 80 of progressively decreasing size or cross-section from channel ends 70*e* towards a midportion of channel 70. In a presently preferred construction, third plate means 78 is formed with relatively uniformly arranged apertures 78*a*, which serve to place flow passages 80 in flow communication with separate volumes 84, which are disposed intermediate the third plate means and side wall 70*c* and of progressively increasing volume in directions away from channel ends 70*e*; and channel ends 70*e* are bridged by fourth plate means 86 having a plurality of apertures 86*a*, which define air inlet openings for flow passages 80**.

Alternatively, the pair of plates comprising the third plate means 78 may be replaced by a single, apertured plate extending along the whole of the length of channel 70 in which case air would be introduced into only one end of the latter.

Further modifications of vent means 34 are possible, such as for instance omission of one or the other of honeycomb element 72 and second plate means 74, and the provision of a solid or non-perforated third plate means 78. However, the omission of the honeycomb element results in degradation of the definition or uniformity of air curtain issuing through slot **70*f* and, alternatively, the omission of the second plate means results in the production of an air curtain which varies lengthwise of the vent means. On the other hand, the use of a non-perforated plate for the third plate means reduces the uniformity of flow volume exiting the vent means lengthwise thereof. Moreover, the illustrated construction is preferred in that it provides for an easily fabricated and relatively low cost construction and the creation of a well defined air curtain of desired air flow rate, which is relatively uniform throughout the length of slot 70*f***.

The air curtain issuing through slot **70*f* diverges or increases slightly in width, as channel 70 is viewed in cross-section, as it flows upwardly towards upper canopy 30 with slot 70*f* being arranged to direct most of the air comprising the air curtain to enter volume 32 rearwardly of free edge 62 of channel portion 60 except for that portion of the air forming the forward or outer boundary of the air curtain which is directed towards the channel portion immediately forwardly of its free edge. The vertical side edges of the air curtain flow upwardly along the facing surfaces of front wall portions 44, with air issuing into volume 32 through the rear ends of flow passageways 46 adjacent rear edges 44***a* tending to prevent degradation/separation of the vertical edges of the air curtain, which might otherwise occur due to turbulence induced frictional effects as the air curtain edges flow upwardly along the front wall portions.

As by way of example of the presently preferred construction, an air curtain flow rate of 550 fpm may be provided having a variation in flow throughout the length of an approximately 8 foot channel not exceeding about plus or minus 10% by providing the channel with approximately 2½ inch by 2½ inch cross-section having a 1 inch wide air discharge slot; a one inch thick honeycomb element having flow paths of nominal ⅛ inch width; second and third plates having 1/16 inch diameter apertures arranged on ⅛ inch centers; a distribution space having a thickness of ⅛ inch; and a fourth plate having 3/16 inch diameter apertures arranged on 3/8 inch centers. This arrangement is adapted to prevent the outflow of fumes through access opening 38, when channel 70 is inclined such that the air passing through discharge slot 70*f* creates an air curtain whose outwardly facing boundary, i.e. the boundary facing the environment, is directed towards channel surface 60*b* immediately adjacent free edge 62.

Exhaust means 40 is shown in FIGS. 1, 2, 6 and 7 as including an inlet portion 90, which depends below upper canopy bottom wall 56 and a main filter portion 92, which is arranged within upper canopy 30 and placed in communication with the inlet portion via bottom wall opening 58.

Inlet portion 90 includes a housing 94 serving to define inlet 42, which is arranged to extend downwardly from adjacent bottom wall 56 and horizontally essentially between side walls 24 and to face downwardly and forwardly towards canopy free edge 62. Housing 94 serves to removably mount a plurality of primary or first filter panels 96, which are of generally rectangular configuration and arranged in an abutting end-to-end, coplanar relationship throughout the length of inlet 42, and a plurality of fixed position, generally rectangular, coplanar flow distributor panels 98*a*– 98*c*, which are spaced from each other and side walls 24 to define flow openings 100*a*–100*d* connecting a first volume 102 bounded by the distributor panels and the filter panels and a second volume 104 bounded by the distributor panels and the rear of the housing. Filter panels 96 may be, if desired, commercially available metal mesh or baffle type panels which may be removed for cleaning on a periodic basis. Grease tending to collect on distributor panels 98*a*–98*c* and/or the interior surfaces of housing 94 may collect adjacent the bottom of the housing and, if desired, be drained therefrom via suitable means, not shown.

Distributor panels 98*a*–98*c* are sized and arranged relative to bottom wall opening 58, such as to cooperate with volumes 102 and 104 to provide for a relatively uniform inflow of fumes and air through inlet 42 throughout its length. As by way of example of a presently preferred construction adapted for use with an installation measuring approximately 8 feet between side walls 24, panels 98*a*–98*c* may have horizontal dimensions of 12, 30 and 21 inches, respectively, and flow openings may have horizontal dimensions of ⅝, 1, 2¼ and 29⅛inches, respectively, for the case where bottom wall opening 58 has a horizontal dimension of 13 inches and its center is spaced 21½ inches from the right hand side wall 24, as viewed in FIG. 6.

Main filter portion 92 includes in combination a secondary filter 108; an equalization chamber 110; a tertiary filter stage 112 comprised of two or more glass-fiber mat filters of generally rectangular plan view configuration and of progressively decreasing mesh; a quaternary filter stage 114 comprised for instance of an activated charcoal type filter or a chemical deodorizer of the pellet or liquid type; and suction fan 116 operable to draw fumes and air in succession through inlet portion 90 and main filter portion 92 and discharge filtered air under pressure. Secondary filter 108 has its inlet communicating with bottom wall opening 58 and operates as a centrifuge causing incoming fumes and air to rapidly change directions and separate therefrom the bulk of grease remaining in the air stream prior to discharge thereof through an axial discharge opening 120 opening centrally through one end of equalization chamber 110 Grease separated from the airstream, while passing through secondary filter 108, may be permitted to flow by gravity for collection in housing 94 and/or collected in a removable drip pan, not shown.

Equalization chamber 110 is required to have a height and depth, as viewed in FIGS. 6 and 7, respectively, which correspond essentially to the plan view dimensions of planar inlet surface 112*a* of the first filter element of tertiary filter stage 112. Equalization chamber 110 is also required to have a length, as measured lengthwise of main filter portion 92 or axially of the air stream passing through discharge opening 120, which is sufficient to permit the air stream to diffuse outwardly and change its flow direction to one which is essentially normal to the surface of the filter inlet surface 112*a*. Chamber 110 is shown in FIG. 6 and 7 as being generally parallelopiped in configuration and defined by surface 110*a*, which extends outwardly of discharge opening 120 in facing relation to filter inlet surface 112*a*, upper and lower surfaces 110*b* and 110*c*, and side surfaces 110*d* and 110*e*. Below a given minimum length, which is determined by the plan view dimensions of filter inlet surface 112*a*, the size of discharge opening 120 and the rate of flow of the air stream passing through the discharge opening, it has been found that only the central portion of the filter inlet surface effectively acts on the air stream for filtering purposes. Above such given minimum length, the whole inlet surface of first filter element becomes effective for filtering purposes, as can be visually observed by the collection of grease particles on the surface of the filter element over time, when placed at varying distances from discharge opening 120. As by way of example, for an equalization chamber having a fixed height and depth of 24 and 24 inches, respectively; a generally square discharge opening of approximately 11 inches on edge and an air stream velocity through the discharge opening of approximately 250 ft./min., first filter element 112*a* must be placed 6 inches or more from the discharge opening to assume essentially uniform coating of the first filter element with grease particles.

By again making reference to FIGS. 2 and 6, it will be noted that the discharge of fan 116 is connected to a main distribution duct 124, which extends lengthwise of upper canopy 30 and has its opposite ends flow connected to branch ducts 126, which extend downwardly and forwardly through side walls 24 for flow communication with the inlet ends of passages 80 via apertures 86*a*. The forward ends of branch ducts also communicate with the lower ends of additional ducts 128, which are arranged to extend upwardly along and rearwardly of side wall front edges 24a and are lengthwise slotted to define vent slots 24c.

In accordance with a preferred form of the invention, that portion of the discharge from suction fan 116 which is not required to create and stabilize the air curtain, is discharged directly to the immediate environment or to a stack, via opening 130, and makeup air admitted to volume 32, as required to maintain some predetermined overall flow through the system. In this respect, it will be understood that the quantity of makeup air drawn into volume 32 by suction fan 116 operating at some given speed is automatically regulated or controlled by the quantity of fumes generated during various stages of a cooking or grilling operation; the requirement for makeup air being decreased with an increase in volume of fumes being generated. Makeup air is introduced into volume 32 via slot 36 and beneath channel portion 60, due principally to the natural tendency of the forward boundary of the air curtain to draw or frictionally drag ambient air for movement therewith upwardly towards the channel portion. Inflow of ambient air rearwardly into volume 32 along outer surface 60b may also occur under certain conditions existing within the volume.

In operation, suction fan 116 would normally be energized when cooking surface 14 is initially heated prior to being placed in use, so as to create a steady state condition, wherein volumes of filtered air are continuously supplied by suction fan 116 to main distribution duct 124 for creating and stabilizing the air curtain and exhausted to the environment via opening 130. In that the volume of air supplied to main distribution duct 124 is less than the volume of air drawn through filter inlet 42, a negative pressure tends to develop within volume 32 with the result that makeup air is drawn into volume 32 via makeup air receiving inlet 36 and beneath channel portion 60. While operating conditions are expected to vary due to different installation requirements, it has been found that satisfactory operating conditions may normally be achieved in cooking environments tested to date by exhausting about two-thirds of the filtered air to the atmosphere, directing about one-third of the filtered air to distribution duct 124 and sizing inlet 36 and directing the air curtain such that about one-half of the required makeup air is introduced through the inlet and the other one-half introduced below channel portion 60. Of the latter, about two-thirds is drawn in by the normal operation of the air curtain and about one-third is drawn in due to the reduced pressure condition created within volume 32. Of the one-third of the filtered air recirculated via duct 124, about ninety percent is used to form the air curtain and about five percent is supplied to each of vent slots 24c, in order to stabilize the vertical side edges of the air curtain.

When a cooking operation commences, fumes are generated or received within volume 32, which, together with filtered air introduced into such volume via main distribution duct 124 and the makeup air, are drawn through filter inlet 42 and pass successively through filter panels 96, secondary filter 108, equalization chamber 110, tertiary filter stage 112 and quaternary filter stage 114 before entering suction fan 116. It is intended that grease be removed from the air stream by the time it has passed through tertiary filter stage 112 such that quaternary filter 114 can effectively perform its deodorizing function to ensure that filtered air discharged from suction fan 116 is both free of grease and noxious fumes.

As previously indicated, the present system is self-regulating from the standpoint that the volume of makeup air drawn into volume 32 tends to decrease, as the volume of fumes generated during the cooking operation increases, whereby pressure within volume 32 tends to remain relatively constant and the position and configuration of the air curtain flowing upwardly across access opening 38 tends to remain relatively stable. The flow parameters are chosen such that makeup air will always be drawn through inlet 36 during contemplated fume generation conditions, since it is critical to the present invention that a flow of air be continuously maintained above the fume generating surface for purposes of directing fumes rearwardly and upwardly towards filter inlet 42.

At certain times during a cooking operation when very large volumes of fumes are momentarily generated, as for instance immediately after high fat content food products, such as hamburgers, are placed on cooking surface 14, it is critical to the trouble free operation of the system that flow of fumes within volume 32 be controlled to prevent the upper extent of the air curtain from being deflected forwardly, such as would permit the escape of fumes to the environment from beneath channel portion 60.

In accordance with the present invention, flow of excessive fumes within volume 32 is controlled in such a manner as to tend to counteract pressure forces otherwise tending to produce outward deflection of the upper extent of the air curtain. Specifically, when fumes are generated in a volume which might overburden the system, the fumes quickly rise towards canopy bottom wall 56 and upon impingement thereagainst divide for flow rearwardly for immediate removal through filter inlet 42 and forwardly towards channel portion 60 whose curved inner surface 60e imparts a downwardly and rearwardly directed movement to the fumes, i.e. counter-clockwise directed rotation, as viewed in FIG. 2. In effect, a flow vortex is created and the flow of fumes rearwardly over free edge 62 tends to lower the effective pressure adjacent the rear portion of outer surface of channel portion 60, thereby counteracting the buildup of pressure within volume 32 otherwise tending to outwardly displace the upper portion of the air curtain. Thus, the shape and placement of channel portion surface 60a allows trouble-free operation of the system, even under extreme momentary fume generation conditions.

The present system may be designed for given fume generating equipment whose maximum fume generating volume or capacity is known and in this case, suction fan 116 may have a predetermined constant speed and discharge opening 130 may have a predetermined size. Alternatively, it is anticipated that suction fan speed and/or discharge opening size may be made adjustable to accommodate a given system for efficient operation with different equipment and/or to accommodate its use with a single piece of equipment having a very wide range of fume generation operating conditions.

The canopy system thus far described is suitable for use with many fume generating installations. However, it has been found that small amounts of fumes may escape to the environment from beneath channel portion 60 during operating conditions under which channel portion outer surface 60b becomes hot, due either to overall high operating temperature of cooking equipment and/or placement of a high heat generating source adjacent the forward portion of surface 14 immediately below the channel portion. Tests have determined that escape of fumes is caused by a convection flow pattern generated immediately adjacent surface 60*b* when same is heated to a sufficiently high temperature, and this pattern tends to draw fumes outwardly of volume 32 for flow outwardly and upwardly along channel portion outer surface 60*b*.

Figure 8:
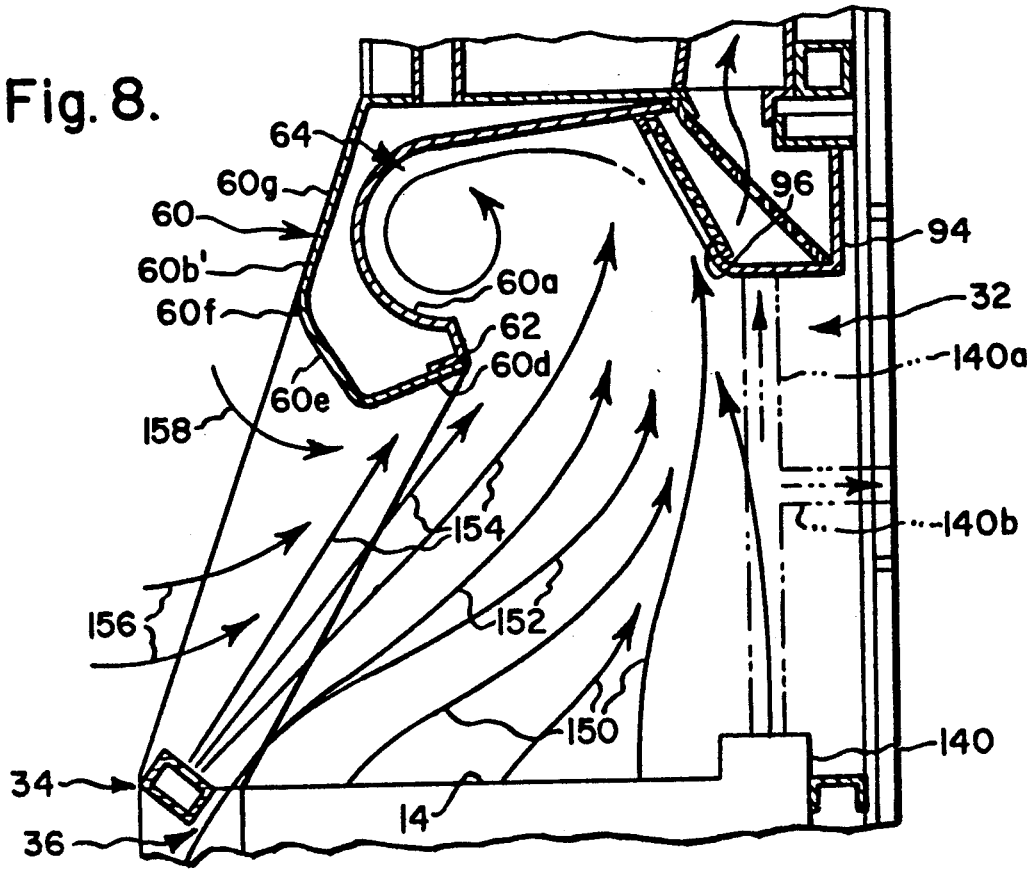
FIGS. 8 and 9 are views similar to FIG. 2, but showing alternative forms of the present invention.

The foregoing condition may be alleviated by artificially cooling surface 60*b*, but alternatively, the external surface of channel portion 60 may be reconfigured in the manner shown in FIG. 8. Specifically, in this alternative construction, channel portion outer surface 60*b'* is defined by a generally planar first panel portion 60*d* arranged to extend downwardly and forwardly from adjacent rear edge 62; a generally planar second panel portion 60*e* arranged to extend upwardly and forwardly from adjacent the first panel portion; a smoothly curved third panel portion 60*f* arranged to extend upwardly from adjacent the second panel portion; and a generally planar fourth panel portion 60*g* arranged to extend upwardly and rearwardly from adjacent the third panel portion towards front wall 54. With first panel portion 60*d* arranged in the manner shown in FIG. 8, it is adapted to reflect heat downwardly and rearwardly into volume 32, and if it becomes sufficiently hot that a convective flow pattern is initiated, such convective flow pattern will tend to draw makeup air into the volume, as opposed to drawing fumes into the environment. Moreover, first panel portion 60*d* is adapted to deflect or direct the air stream impinging thereon rearwardly into volume 32 whenever it is temporarily displaced forwardly as a result of momentary high pressure condition within the volume generated by the creation of excessive fumes. Of less operational significance, is the provision of the corner defined by panel portions 60*d* and 60*e*, which tends to create a weak counterclockwise rotating vortex adjacent the outer edge of panel portion 60*d*, as viewed in FIG. 8, which tends to retard escape of any "puff" of fumes, which might otherwise tend to escape past the boundary established by the air curtain at the initiation of an excessive fume generation condition.

Also in FIG. 8, equipment 12 is shown as being a gas fired cooking unit from which combustion gases are vented directly upwardly into the rear of volume 32 via a discharge 140. For equipment wherein the volume of combustion gases may be varied incident to normal equipment operation, it may be desired to direct the exhaust gases directly to housing 94 via a conduit 140*a* in order to limit their affect on the typical flow pattern depicted in FIG. 8, wherein arrows 150 designate the flow of fumes generated adjacent cooking surface 14, arrows 152 designate makeup air entering through inlet 36 and serving to force the fumes to flow rearwardly within volume 32, arrows 154 designate the air screen, arrows 156 designate makeup air tending to be drawn into volume 32 by the air screen and arrow 158 designates makeup air tending to be drawn in beneath channel portion 60 as a result of low pressure conditions existing within volume 32 and due to any convective flow pattern resulting from the heating of first panel portion 60*d*. For installations where code requirements necessitate exhausting combustion gases to the atmosphere via a stack, not shown, discharge 140 may be fitted with a conduit 140*b* exiting volume 32 for connection to such stack. For this latter situation, operation of the present canopy system is no different for the case of gas fired cooking equipment than for electric powered cooking equipment generally depicted in FIG. 2.

Figure 9:
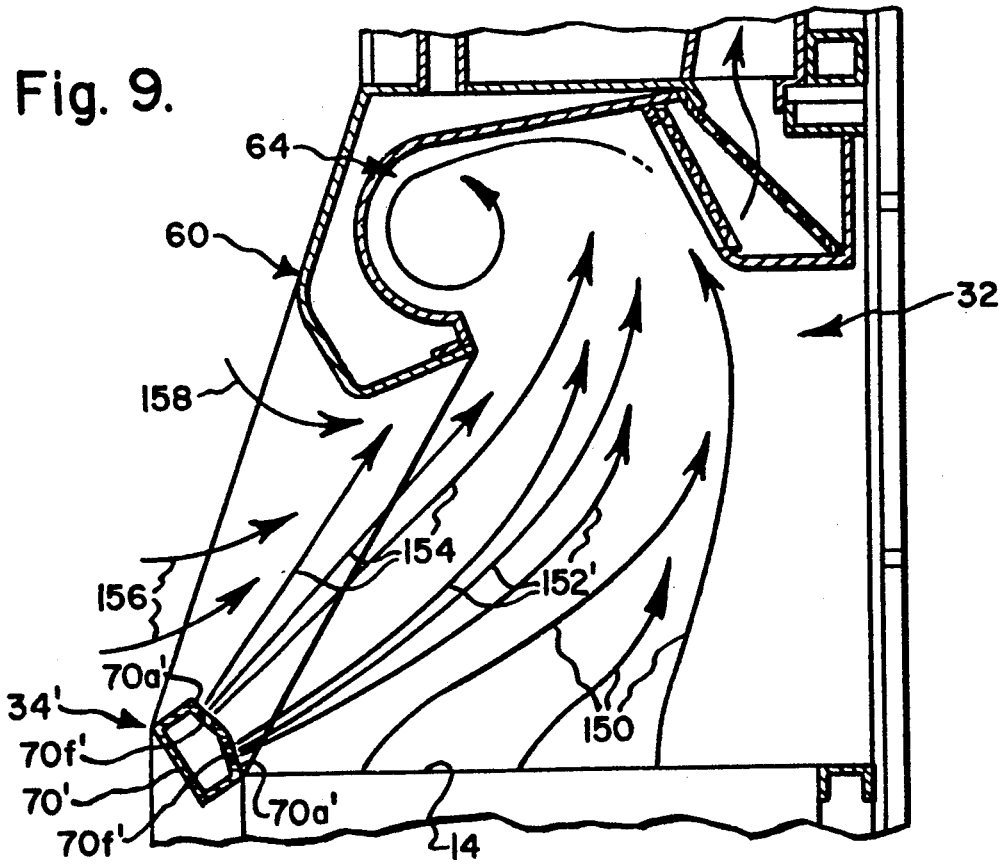

FIG. 9 illustrates an alternative canopy system particularly adapted for use in those situations where it is necessary to minimize the amount of makeup air introduced into volume 32, due to the cost of heating or cooling air present in the environment in which the equipment 12 is located. This construction departs from that illustrated in FIGS. 2 and 8 in the absence of inlet 36 or blocking thereof in order to prevent or at least substantially reduce the inflow of makeup air to volume 32 between cooking surface 14 and vent means 34', and in modification of the vent means to create both the previously described air curtain and a secondary air curtain or flow pattern designated by arrows 152', which serves, in place of makeup air previously introduced through inlet 36, to direct fumes 150 rearwardly within volume 32. With this construction, volume 32 would receive about two-thirds filtered air and about one-third makeup air under steady state conditions, and flows would be selected to ensure the introduction of makeup air under all operating conditions expected to be encountered during use. Vent means 34' is generally depicted in FIG. 9 as including a channel 70' having angularly related side walls 70*a* and 70*a'*, which are formed with air discharge slots 70*f* and 70*f'* for producing the air curtain and secondary air curtain, respectively. The interior of channel 70' may be similar in construction to that described with reference to channel 70 with changes in aperture sizing of the honeycomb elements associated with slots 70*f* and 70*f'* being made, if desired to vary the flow characteristics of the air curtains. Alternatively, wholly independent flow passages may be provided to supply air to slots 70*f* and 70*f'*.

What is claimed is:

1. A canopy system for use in combination with equipment producing fumes whose escape into the environment adjacent the equipment is not desired, said equipment having front, rear and sides, and said system comprising: rear and side walls adapted to upstand from adjacent said rear and sides; an upper canopy surmounting said rear and side walls and cooperating therewith to define a volume for receiving fumes produced by said equipment; means for producing an air curtain including an air curtain directing means arranged to extend substantially between said side walls in a forwardly spaced relationship from said front for cooperation with said front to bound a make-up air receiving inlet for permitting passage of air from said environment into said volume and for cooperation with said side walls and said upper canopy to bound an access opening for said volume, said air curtain directing means directs an air curtain towards said upper canopy; and exhaust means having an exhaust inlet extending along an upper extent of said rear wall for withdrawing fumes and air from said volume.

2. The system according to claim 1, wherein said upper canopy includes a depending and inwardly projecting channel portion terminating in a rearwardly facing free edge, said channel portion defining a vortex chamber opening rearwardly towards said exhaust inlet.

3. The system according to claim 2, wherein said side walls have forward edges thereof mounting facing front wall portions, said front wall portions having rear edges converging upwardly towards said channel portion and cooperating with said channel portion and said air curtain directing means to define said access opening.

4. The system according to claim 3, wherein said side walls have front edges and vent openings adjacent said front edges, said side walls cooperate with said front wall portions to define flow passages having inlet ends communicating with said vent openings and outlet ends adjacent said rear edges arranged in communication with said volume, and means are provided to introduce air through said vent openings for flow into said volume through said flow passages.

5. The system according to claim 4, wherein said rearwardly facing free edge of said channel portion is disposed horizontally intermediate said means for producing said air curtain and said exhaust inlet, said rear edges of said front wall portions incline upwardly and rearwardly from adjacent said means for producing said air curtain towards said rearwardly facing free edge, and said outlet ends of said flow passages open downwardly and rearwardly into said volume.

6. The system according to claim 1, wherein said air curtain directing means includes at least on air flow duct having an elongated flow passage extending lengthwise thereof, an air inlet opening adjacent one end of said elongated flow passage, an elongated slot opening arranged to face towards said upper canopy and for communication throughout the length thereof with said elongated flow passage, first plate means in the form of a honey comb bridging said slot and defining closely spaced parallel flow paths directed towards said upper canopy through said elongated slot, second plate means disposed in a generally parallel and spaced relation to said first plate means and having apertures extending therethrough for delivering air from said elongated flow passage to a space defined by said first and second plate means and therefrom to said parallel flow paths to create said air curtain.

7. The combination according to claim 6, wherein said duct is of essentially uniform cross-section throughout the length thereof and a third plate means is disposed within said duct for cooperation with said second plate means to progressively decrease the size of said elongated flow passage in a direction extending away from said air inlet opening and for cooperation with said duct to create a separate volume progressively increasing in size in a direction away from said air inlet opening, and said third plate means is apertured to place said elongated flow passage and said separate volume in flow communication at least throughout a substantial portion of the lengths thereof.

8. The system according to claim 1, wherein said exhaust means includes air filter means and a suction fan for drawing fumes and air from said volume successively through said exhaust inlet and said air filter means and discharging filtered air under pressure, and said system includes a discharge opening disposed in flow communication with the suction fan for directing a portion of said filtered air to said environment and a duct disposed in flow communication with said suction fan for directing another portion of said filtered air to said means for producing said air curtain.

9. The system according to claim 1, wherein said exhaust means includes a cyclone separating means having an axially directed air outlet having an air flow axis and a generally rectangular filter means having a filter inlet surface disposed normal to said air flow axis and having a centrally disposed portion of said filter inlet surface arranged in alignment with said air outlet, said filter inlet surface being substantially larger than the cross-sectional area of said air outlet, and an equalization chamber of generally parallelopiped configuration and communicating at opposite ends thereof with said air outlet and substantially the whole of said filter inlet surface, and said opposite ends are spaced one from another sufficiently to permit air passing into said equalization chamber from said air outlet to diffuse outwardly and change its flow direction to one which is essentially normal to said filter inlet surface to provide for relatively uniform passage of air through said filter inlet surface.

10. The system according to claim 1, wherein said upper canopy includes a bottom wall having an opening therein arranged adjacent said rear wall and relatively closer to one of said side walls than to another of said side walls, and said exhaust means includes an inlet portion depending below said upper canopy and a main filter portion arranged within said upper canopy and disposed in flow communication with said inlet portion via said opening in said bottom wall, said inlet portion including a housing defining said exhaust inlet extending substantially between said side walls and opening downwardly and forwardly towards said means for providing said air curtain, a plurality of filter panels arranged end to end in overlying relation to said exhaust inlet, and a plurality of essentially coplanar flow distributing panels dividing said housing lengthwise thereof between said side walls into a first volume for receiving flow passing through said filter panels and a second volume communicating with said opening in said bottom wall, and said distributing panels being sized and spaced from one another and said side walls to provide for relatively uniform air flow through said filter panels lengthwise of said exhaust inlet upon movement of air from said second volume to said main filter portion through said opening in said bottom wall.

11. A system according to claim 10, wherein said main filter portion includes a cyclone separating means having an inlet communicating with said opening in said bottom wall and an axially directed air outlet having an air flow axis and a generally rectangular filter means having a filter inlet surface disposed normal to said air flow axis and having a centrally disposed portion of said filter inlet surface arranged in alignment with said air outlet, said filter inlet surface being substantially larger than the cross-sectional area of said air outlet, and an equalization chamber communicating at opposite ends thereof with said air outlet and substantially the whole of said filter inlet surface, and said opposite ends are spaced one from another sufficiently to provide for relative uniform passage through said filter inlet surface of air passing into said equalization chamber from said air outlet.

12. A system according to claim 11, wherein said main filter portion includes a suction fan having an inlet communicating with said rectangular filter means and an outlet, said outlet being connected to the environment and conduit means leading to said means for producing an air curtain.

13. A system according to claim 12, wherein said side walls have vent means for introducing air into said volume adjacent opposite vertical edges of said access opening, and said vent means is disposed in flow communication with said duct means.

14. A system according to claim 1, wherein said upper canopy includes a depending channel portion terminating in a rearwardly falling free edge and having inner and outer surfaces, said inner surface defining a curved vortex chamber extending upwardly then adjacent said free edge and opening rearwardly towards said exhaust inlet, and said outer surface including a first panel portion extending downwardly and forwardly from adjacent said free edge in facing relationship to said equipment and a second panel portion extending upwardly from adjacent an edge of said first panel portion spaced from said free edge.

15. A system according to claim 14, wherein said first panel portion is disposed horizontally intermediate said means for producing said air curtain and said exhaust inlet, and an outer boundary of said air curtain arranged in a facing relation to said environment being directed towards said first panel portion adjacent said free edge.

16. A system according to claim 15, wherein flow passages are arranged to direct air into said volume along vertically extending opposite ends of said air curtain disposed adjacent said side walls, said exhaust means includes air filter means and a suction fan for drawing fumes and air from said volume successively through said exhaust inlet and said air filter means and discharging filtered air under pressure, and said system includes a discharge opening disposed in flow communication with the suction fan for directing a portion of said filtered air to said environment and a duct disposed in flow communication with said suction fan for directing another portion of said filtered air to said means for producing said air curtain and to said flow passages.

17. A canopy system for use in combination with equipment producing fumes whose escape into the environment is not desired, said system comprising in combination:

means defining a volume for receiving said fumes and an access opening for affording access to said volume from said environment, said access opening having an upper edge, a lower edge and opposite side edges;

means having an inlet communicating with said volume, filter means and an outlet, said inlet extending lengthwise of and in spaced relationship to said upper edge;

suction means communicating with said outlet for drawing fumes and air from said volume successively through said inlet, said filter means and said outlet and discharging under pressure air filtered by said filter means;

a discharge for discharging a portion of said filtered air to said environment;

means receiving an other portion of said filtered air for creating an air curtain directed upwardly from adjacent said lower edge and across said access opening between said side edges towards said inlet; and means for supplying air to said volume from said environment incident to a decrease in pressure existing within said volume relative to the pressure existing in said environment, and said means defining said volume includes a vortex chamber extending lengthwise adjacent said upper edge and opening towards said inlet, and a wall extending between said vortex chamber and said inlet, said wall dividing fumes rising within said volume for flow rearwardly within said volume towards said inlet and forwardly within said volume towards said vortex chamber, and said vortex chamber imparts downwardly and rearwardly movement to said fumes.

18. The system according to claim 17, wherein said opposite side edges are vertically inclined and said upper edge is horizontally offset from said lower edge whereby said access opening opens downwardly into said volume towards said equipment; and said means for supplying air to said volume includes a makeup air inlet opening upwardly into said volume and arranged to extend adjacent to and lengthwise of said lower edge between said air curtain and said equipment.

19. A system according to claim 18, wherein said means receiving an other portion of said filtered air creates flows of said filtered air directed downwardly and inwardly of said volume from adjacent said opposite side edges.

20. A canopy system for use in combination with equipment producing fumes whose escape into the environment is not desired, said system comprising in combination:

means defining a volume disposed above said equipment for receiving said fumes and an access opening adjacent one side of said equipment for affording access to said volume from said environment, said access opening having an upper edge, a lower edge and opposite side edges;

having an inlet, filter means and an outlet, said inlet and said access opening communicating with said volume adjacent horizontally opposed sides of said equipment with said lower edge being disposed vertically adjacent said equipment and said inlet being disposed vertically remote from said equipment;

suction means communicating with said outlet for drawing fumes and air from said volume successively through said inlet, said filter means and said outlet and discharging under pressure air filtered by said filter means;

a discharge for discharging a portion of said filtered air to said environment;

means receiving an other portion of said filtered air for creating an air curtain directed upwardly from adjacent said lower edge and across said access opening between said side edges towards said inlet; and means for receiving a further portion of said filtered air for creating a filtered air flow directed from adjacent said lower edge towards said inlet and intermediate said air curtain and said equipment.

21. A system according to claim 20, wherein further means are provided for receiving a portion of said filtered air to create flows of said filtered air directed into said volume from adjacent said opposite side edges.

22. A system according to claim 21, wherein said upper edge is defined by a free edge of a channel portion having a curved inner surface opening towards said inlet and an outer surface, said free edge being disposed horizontally intermediate said lower edge and said inlet, said outer surface including a first panel portion extending from said free edge downwardly and relatively towards said lower edge in facing relation to said equipment and a second panel portion extending upwardly from adjacent an edge of said first panel portion disposed remotely of said free edge, and a boundary of said air curtain arranged in facing relation to said environment being directed towards said first panel portion.

23. A method of preventing escape into the environment of fumes generated by equipment, said method comprising:

providing an enclosure defining a volume for receiving said fumes and an access opening for affording access to said volume, said access opening having an upper edge, a lower edge and opposite side edges;

providing air filtering means having an inlet communicating with said volume remotely of said access opening, air filter means and an outlet;

providing suction means connected to said outlet for drawing said fumes and air from said volume through said inlet and through said filter means and for discharging filtered air under pressure;

conducting a portion of said filtered air to said environment in an amount exceeding a maximum volume of fumes expected to be generated by said equipment;

conducting a remaining portion of said filtered air in an amount less than said portion to said lower edge for creating an air curtain extending upwardly across said access opening between said opposite side edges for flow into said volume and to said opposite side edges for creating flows of filtered air into said volume adjacent opposite sides of said air curtain disposed adjacent said opposite side edges;

providing a makeup air inlet means extending along said lower edge for creating a flow of air from said environment into said volume between said air curtain and said equipment in response to reduction in pressure within said volume incident to withdrawal of said fumes and air from said volume in an amount exceeding an amount of said remaining portion of said filtered air introduced into said volume.

24. A method of preventing escape into the environment of fumes generated by equipment, said method comprising:

providing an enclosure defining a volume for receiving said fumes and an access opening for affording access to said volume, said access opening having an upper edge, a lower edge and opposite side edges;

providing air filtering means having an inlet arranged to communicate with an upper extent of said volume, air filter means and an outlet, said inlet being disposed remotely of and extending lengthwise of said upper edge;

providing suction means connected to said outlet for drawing said fumes and air from said volume through said inlet and through said filter means and for discharging filtered air under pressure;

providing a filtered air discharge opening for discharging a portion of said filtered air to said environment;

providing means for conducting an other portion of said filtered air for creating an air curtain extending along said lower edge and directed upwardly across said access opening between said opposite side edges for receipt within said volume and for creating air flows into said volume from adjacent said opposite side edges;

providing a makeup air inlet extending lengthwise of said lower edge for permitting flow of air from said environment into said volume adjacent an inner boundary of said air curtain facing away from said environment;

correlating the amount of said filtered air discharged from said suction means, the amount of said portion of said filtered air discharged to said environment, the amount of said other portion of said filtered air conducted for creating said air curtain and said air flows and the size of said makeup air intake to prevent movement of said air curtain from engagement with said upper edge incident to fluctuations in the volume of said fumes generated by said equipment.

25. A method according to claim 24, wherein about two-thirds of said filtered air is discharged to said environment and one-third of said filtered air is reintroduced into said volume.

26. A method of preventing escape into the environment of fumes generated by equipment, said method comprising:

providing an enclosure defining a volume for receiving said fumes and an access opening for affording access to said volume, said access opening having an upper edge, a lower edge and opposite side edges;

providing air filtering means having an inlet arranged to communicate with an upper extent of said volume, air filter means and an outlet, said inlet being disposed remotely of and extending lengthwise of said upper edge;

providing suction means connected to said outlet for drawing said fumes and air from said volume through said inlet and through said filter means and for discharging filtered air under pressure;

discharging a portion of said filtered air to said environment in an amount exceeding the maximum amount of fumes expected to be generated by said equipment;

conducting an other portion of said filtered air for creating an air curtain extending along said lower edge and directed upwardly across said access opening between said opposite side edges for receipt within said volume and for creating air flows into said volume from adjacent said opposite side edges; and conducting a further portion of said filtered air for creating a flow of filtered air extending along said lower edge and directed into said volume intermediate said air curtain and said equipment.

27. A method according to claim 26, wherein about one-third of said filtered air is discharged to said environment and about two-thirds of said filtered air is reintroduced into said volume.

28. A method according to claim 27, wherein said other portion and said further portion each constitute about one-half of said filtered air reintroduced into said volume.

29. In a system for use in combination with equipment producing fumes whose escape into the environment is not desired and including air filtering means having an inlet for receiving said fumes, air filter means and an outlet, and suction means connected to said outlet for drawing said fumes through said inlet and through said filter means, the improvement comprising;

said filter means includes a cyclone separating means having an axially directed air outlet having an air flow axis and a generally rectangular filter means having a filter inlet surface disposed normal to said air flow axis and having a centrally disposed portion of said filter inlet surface arranged in alignment with said air outlet, said filter inlet surface being substantially larger than the cross-sectional area of said air outlet, and an equalization chamber of generally parallelopiped configuration and communicating at opposite ends thereof with said air outlet and substantially the whole of said filter inlet surface, and said opposite ends are spaced one from another sufficiently to permit air passing into said equalization chamber from said air outlet to diffuse outwardly and change its flow direction to one which is essentially normal to said filter inlet surface to provide for relative uniform passage through said filter inlet surface of air passing into said equalization chamber from said air outlet.

* * * * *

UNITED STATES PATENT AND TRADEMARK OFFICE

CERTIFICATE OF CORRECTION

PATENT NO. : 5,251,608

DATED : 10/12/93

INVENTOR(S) : Cameron Cote

It is certified that error appears in the above-identified patent and that said Letters Patent is hereby corrected as shown below:

On the Title Page, Item [57];
In the Abstract, line 8 - after "an", insert --air curtain--.

Col. 3, line 42 - after "volume", insert --32--.

Col. 14, line 23 - before "having", insert --means--.

Signed and Sealed this

Twenty-first Day of June, 1994

Bruce Lehman

*Attest:*

BRUCE LEHMAN

*Attesting Officer*

*Commissioner of Patents and Trademarks*